US007169094B2

(12) United States Patent
Ardito, III

(10) Patent No.: US 7,169,094 B2
(45) Date of Patent: Jan. 30, 2007

(54) CIRCULAR FITNESS APPARATUS

(75) Inventor: Frank R. Ardito, III, Cherry Valley, IL (US)

(73) Assignee: Corepole, Inc., Belvidere, IL (US)

( * ) Notice: Subject to any disclaimer, the term of this patent is extended or adjusted under 35 U.S.C. 154(b) by 624 days.

(21) Appl. No.: 10/679,854

(22) Filed: Oct. 6, 2003

(65) Prior Publication Data

US 2004/0072663 A1 Apr. 15, 2004

Related U.S. Application Data

(60) Provisional application No. 60/417,351, filed on Oct. 9, 2002.

(51) Int. Cl.

| | |
|---|---|
| ***A63B 21/04*** | (2006.01) |
| ***A63B 21/055*** | (2006.01) |
| ***A63B 21/16*** | (2006.01) |
| *A63B 21/28* | (2006.01) |

(52) U.S. Cl. ..... 482/129; 482/121; 482/148

(58) Field of Classification Search ..... 482/23, 482/33, 51, 90, 91, 92, 95, 121, 129, 139, 482/148, 906, 907; D21/662, 686; 434/250; 446/490; 472/133, 137; 473/575, 576; 273/451, 453

See application file for complete search history.

(56) References Cited

U.S. PATENT DOCUMENTS

| | | | | |
|---|---|---|---|---|
| 232,579 | A | 9/1880 | Weeks | |
| 425,636 | A * | 4/1890 | Shaw | 482/23 |
| 1,112,114 | A | 9/1914 | Caines | |
| 1,965,511 | A | 7/1934 | Preston | |
| 2,680,967 | A | 6/1954 | Newman | |
| 3,103,357 | A | 9/1963 | Berne | |
| 3,288,413 | A * | 11/1966 | Gregory | 248/158 |
| 3,415,515 | A * | 12/1968 | Otto | 482/82 |
| 3,430,953 | A | 3/1969 | Teetor | |
| 3,587,319 | A | 6/1971 | Andrews | |
| 3,643,947 | A * | 2/1972 | Collins | 463/58 |
| 3,659,844 | A | 5/1972 | Cummins | |
| 3,847,422 | A | 11/1974 | Gulistan | |
| 3,923,302 | A * | 12/1975 | Boggild | 482/33 |

(Continued)

FOREIGN PATENT DOCUMENTS

DE 2004006483 U1 * 8/2004

(Continued)

OTHER PUBLICATIONS

SPORTIME, Spring 2001 Elementary catalog, pp. 40-49 (The Big Red Base System) and p. 203, received in the USPTO Feb 2001.*

(Continued)

*Primary Examiner*—Jerome Donnelly
*Assistant Examiner*—Victor K. Hwang
(74) *Attorney, Agent, or Firm*—Reinhart Boerner Van Deuren P.C.

(57) ABSTRACT

A circular fitness apparatus and method. The circular fitness apparatus includes plural flexible exercise attachments attached to a vertical pole in a hollow circular base that can be selected and used for simultaneous group or individual fitness exercises by plural exercise participants. The circular fitness apparatus is useable for group and individual exercise activities comprising health based, skill based and functional based fitness activities.

18 Claims, 9 Drawing Sheets

U.S. PATENT DOCUMENTS 3,956,911 A 5/1976 Carboud
3,984,136 A 10/1976 Bills
4,018,437 A 4/1977 LoPresti
4,109,907 A 8/1978 Zito
4,113,221 A 9/1978 Wehner
4,182,510 A 1/1980 Lundell
4,185,816 A 1/1980 Bernstein
4,212,458 A 7/1980 Bizilia
4,266,766 A 5/1981 Calderone
4,330,131 A * 5/1982 Warehime ..... 473/575
4,357,010 A 11/1982 Telle
4,412,677 A 11/1983 Viramontes
4,419,990 A 12/1983 Forster
D277,218 S 1/1985 Hinds
4,572,505 A 2/1986 Kornhaus
4,662,629 A 5/1987 Plovie
4,720,099 A 1/1988 Carlson
4,749,185 A 6/1988 Spears
4,779,867 A 10/1988 Hinds
4,787,626 A 11/1988 Gallagher
4,809,971 A 3/1989 Goldish
4,848,741 A 7/1989 Hermanson
4,944,518 A 7/1990 Flynn
5,135,445 A 8/1992 Christensen
5,152,728 A * 10/1992 Podd, III ..... 482/51
5,176,602 A 1/1993 Roberts
5,183,452 A 2/1993 Bacon
5,230,676 A 7/1993 Terauds
5,342,274 A 8/1994 Hunker
5,354,253 A 10/1994 Awbrey
5,372,556 A 12/1994 Ropp
5,393,286 A 2/1995 Cheng
5,407,414 A 4/1995 Bass
5,431,617 A 7/1995 Rattray
5,505,677 A 4/1996 Hinds
5,514,059 A 5/1996 Rumney
5,540,643 A 7/1996 Fontaine
5,549,528 A * 8/1996 Bryant ..... 482/81
5,549,532 A 8/1996 Kropp
5,554,088 A * 9/1996 Zlojutro ..... 482/83
5,571,064 A 11/1996 Holm
5,603,681 A 2/1997 Olschansky
5,626,546 A 5/1997 Little
5,676,627 A 10/1997 Howse
5,716,308 A 2/1998 Lee
5,720,701 A 2/1998 Truini
5,720,702 A 2/1998 Lee
5,792,032 A * 8/1998 Williams et al. ..... 482/83
5,800,323 A 9/1998 Ansel
5,895,343 A 4/1999 Huang
6,080,089 A * 6/2000 Nicholson ..... 482/83
6,120,421 A 9/2000 Koo
6,254,517 B1 7/2001 Kennedy
6,319,179 B1 11/2001 Hinds
6,500,102 B1 12/2002 Domenge
6,524,226 B2 * 2/2003 Kushner ..... 482/126
2004/0072663 A1 * 4/2004 Ardito, III ..... 482/121

FOREIGN PATENT DOCUMENTS

WO WO 2003000348 A2 * 1/2003

OTHER PUBLICATIONS

WO 2004/033,051 International Search Report (PCT/US2003/031,931.

* cited by examiner

CIRCULAR FITNESS APPARATUS

CROSS REFERENCES TO RELATED APPLICATIONS

This U.S. Patent Application claims priority from U.S. Provisional Patent Application No. 60/417,351, filed Oct. 9, 2002, the contents of which are incorporated by reference.

FIELD OF THE INVENTION

This invention relates to exercise equipment. More specifically, it relates to a circular fitness apparatus and method.

BACKGROUND OF THE INVENTION

Group physical activity is as old as humankind itself. The concept of physical activity performed in a circle around a pole dates back many thousands of years. Individuals would gather around a tall column, from which multi-colored strips of cloth or rope were suspended. The participants would engage in a series of choreographed movements around the column while music was played. This type of physical activity around a pole was also known as the "May Pole Dance."

May Poles were typically used to usher in the spring season. Villagers would go out into the forest, cut down an appropriately sized tree, and decorate it in the town square with ribbons and flowers. The villagers would engage in group movements to music appreciative of the coming spring.

Circular physical activity and/or the May Pole concept capitalizes on human nature and the desire to work together, play together and with grow with one-another. Anyone who has witnessed "the wave" being performed by thousands in a stadium can understand this concept quite well, and those who have actually participated know first-hand the enjoyment and feeling of "togetherness" that participation truly brings.

There are several problems associated with using a pole and a circular activity concept for group exercise. One problem is that most health and fitness clubs do not have poles with multiple ribbons or ropes. Another problem is that if a pole with ribbons or ropes would be available, the multiple ribbons can typically only be used for fixed height, selected dance activities. Such poles with ribbons typically could not be used for health based, skill based or functional based fitness activities. Another problem is that adults interested in health and fitness activities are not likely to consider circular group activity around a pole with colorful ribbons without fear of ridicule by others.

Thus, it would be desirable to provide a circular exercise device comprising a specialized pole that could be used in health and fitness clubs for group or individual exercise activity. The circular exercise device should be useable for circular individual or group activities comprising health based, skill based and functional based fitness activities.

SUMMARY OF THE INVENTION

In accordance with preferred embodiments of the present invention, some of the problems associated with group exercise activity are overcome. A circular fitness apparatus and method is presented. The circular fitness apparatus and method may be used for circular individual or group activities comprising health based, skill based and functional based fitness activities.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

Circular Fitness Apparatus

Figure 1:
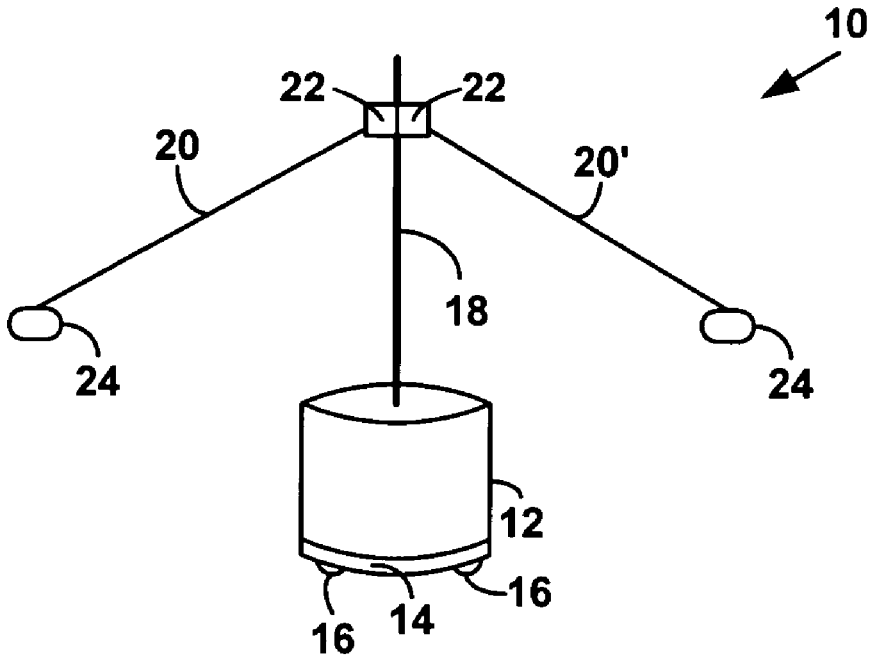
FIG. 1 is a block diagram of a circular fitness apparatus.

FIG. 1 is a block diagram of a circular fitness apparatus 10. The circular fitness apparatus 10 comprises a central hollow circular base 12. In one embodiment of the invention, the central hollow circular base 12 is a smooth circular or oval shape standing approximately twenty-four to approximately thirty-six inches high with a diameter ranging from twenty-four inches to thirty-six or more inches. However, the present invention is not limited to these measurements or shapes, and other measurements and other shapes (e.g., trapezoid, square, rectangle, etc.) can also be used for the central hollow circular base 12. In another embodiment of the present invention, the central hollow circular base 12 is contoured as is explained below.

In one embodiment of the present invention, the central hollow circular base 12 comprises a single piece of stainless steel with hollow, fillable walls. However, the invention is not limited to such an embodiment and central hollow circular base 12 can comprise multiple pieces, and can include other materials (e.g., composite materials, fiberglass, other metals, plastics, etc.).

In one embodiment of the present invention, the stainless steel is brushed-clear coated stainless steel of various colors (e.g., red, green, blue, natural steel, etc.). The coating is used to help resist corrosion from sweat from exercise participants. However, the invention is not limited to such an embodiment and the stainless steel can be processed, coated and colored in other ways.

Figure 2:
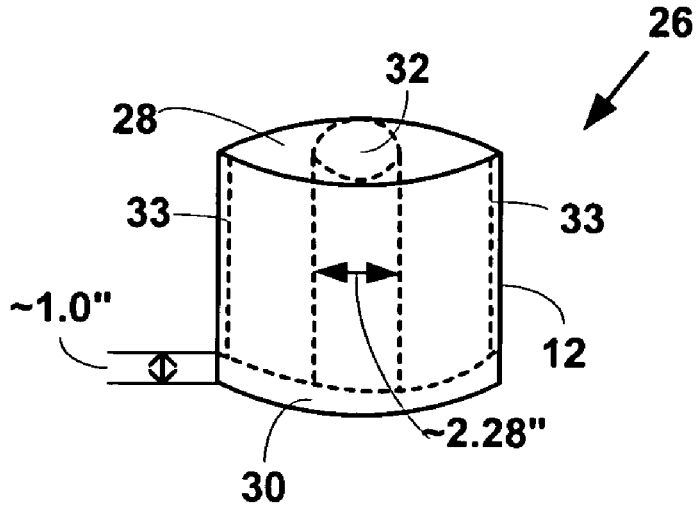
FIG. 2 is a block diagram illustrating a perspective view of an exemplary central hollow circular base component of the circular fitness apparatus of FIG. 1A.

FIG. 2 is a block diagram illustrating a perspective view 26 of an exemplary central hollow circular base 12 component of the circular fitness apparatus 10. The central hollow circular base 12 includes a solid component 28 and plural hollow components 30, 32. The solid component includes hollow, fillible walls 33.

A horizontal hollow component 30 is approximately one-inch in height and is used to hold a rubberized non-skid, non-marring bottom plate 14 attached to the central hollow circular base 12. The rubberized non-skid, non marring bottom plate 14 is used to provide a non-slip surface for the central hollow circular base 12. The bottom plate 14 provides additional stability for the central hollow circular base 12.

In one embodiment of the present invention, the bottom plate 14 is a rubberized gasket, with an internal portion that is slightly smaller than a diameter of the central hollow circular base 12 that fits inside the horizontal hollow component 30 and an external portion including a raised lip that fits over the central hollow circular base 12. In another embodiment, the bottom plate 14 is a rubberized gasket that includes a raised lip that fits over the central hollow circular base 12 with an internal portion that fits into the horizontal hollow component. In both of these embodiments, the raised lip helps create a suction seal when pressure is applied to the central hollow circular base 12.

In another embodiment of the present invention, the bottom plate 14 is a piece of rubberized material that is slightly smaller than a diameter of the central hollow circular base 12 and slightly smaller in height than the height of the horizontal hollow component 30.

For example, if an exemplary diameter of the central hollow circular base is thirty-six inches, and the depth of the horizontal hollow component 30 is one-inch, an exemplary diameter of the bottom plate 14 may be thirty-five and three-quarter inches and an exemplary height of the bottom plate 14 may be three-quarters of an inch. The quarter-inch gaps allow an air pocket to be formed between the central hollow circular base 12 and the bottom plate 14.

The bottom plate 14 is used to provide a seal (e.g., an air suction seal) between the central hollow circular base 12 and a surface it is placed upon (e.g., an exercise floor) when pressure is applied to it (e.g., by stepping on it). The seal adds additional stability 10 to the central hollow circular base 12 during exercise activities.

The central hollow circular base 12 comprises a weight of approximately fifty pounds and its hollow walls can be filled with sand, concrete or other materials to comprise a weight of approximately 200 pounds when filed for additional stability.

A central vertical hollow component 32 is located at a center point of the central hollow circular base 12 is used to hold a vertical pole 18. The central vertical hollow component 32 includes a diameter slightly larger than a diameter of the vertical pole 18 to allow the vertical pole to be inserted and removed easily.

In one embodiment of the present invention, the vertical pole 18 ranges in height from six feet to six feet ten inches in length to accommodate standard seven foot ceilings. The vertical pole 18 also comprises a diameter of 2.25 inches. In such an embodiment, the central vertical hollow component 32 includes a diameter of 2.28 inches. However, the present invention is not limited to these measurements and other measurements and other diameters can also be used for the vertical pole 18 and the central vertical hollow component 32.

In one embodiment of the present invention, the vertical pole 18 comprises a single stainless steel tube. However, the present invention is not limited to such an embodiment and other materials (e.g., other metals, composite materials, wood, plastic, etc.) can also be used for the vertical pole 18.

The vertical pole 18 can also comprise multiple pieces that are permanently attached (e.g., plural stainless steel tubes welded together etc.) or non-permanently attached (e.g., plural stainless steel tubes attached with pins such as spring-loaded pins, that fit into pre-drilled holes, etc.).

In another embodiment of the invention, the central hollow circular base 12 is a contoured shape with plural contours standing approximately ten inches high. The contoured shape allows the hollow circular base 12 to be transported more easily and also allows the hollow circular base 12 to be included in, and used as part of exercise methods performed on the circular fitness apparatus 10. The contoured shape may also provide additional stability for the hollow circular base 12 and not cause tripping by exercise participants.

Figure 3A:
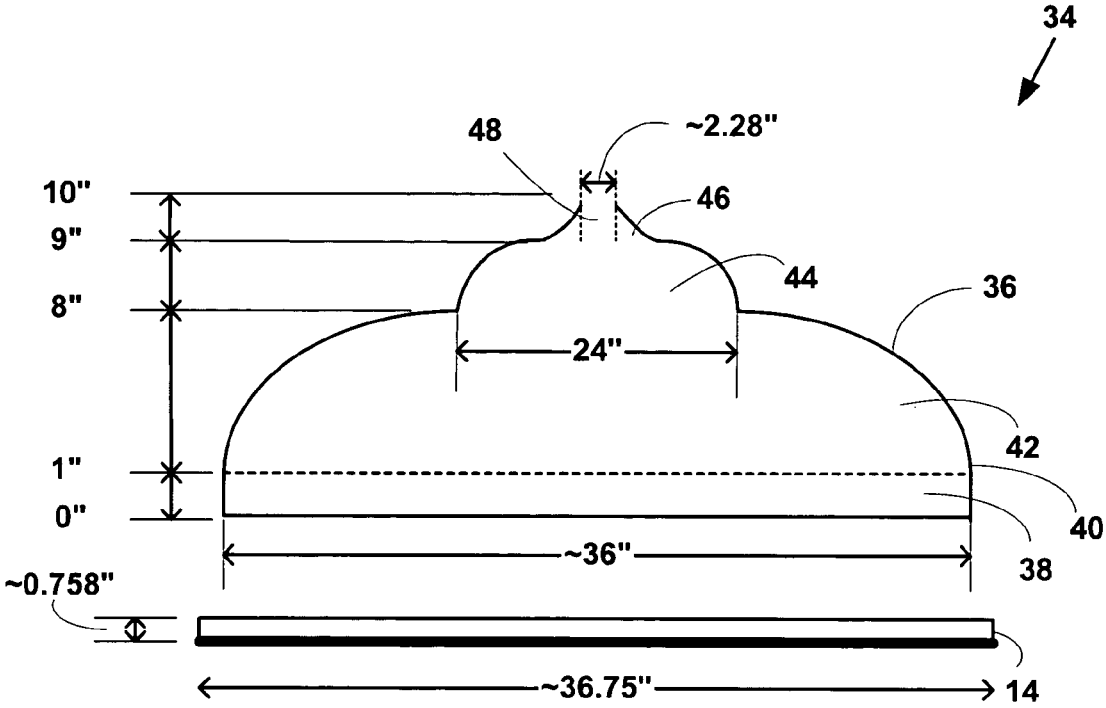
FIG. 3A is a block diagram illustrating a side view of an exemplary contoured circular hollow circular base.

FIG. 3A is a block diagram illustrating a side view 34 of an exemplary contoured 36 central hollow circular base 12. The exemplary contoured circular hollow circular base 36 includes a first contour 38 with an outside diameter of thirty-six inches. The first contour 38 is one inch in height and includes a hollow horizontal component 40 (illustrated by the dotted line) one-inch in height in which the bottom plate 14 is attached.

The exemplary contoured circular hollow circular base 36 includes a second contour 42 from one inch in height, until eight inches in height. The diameter of the second contour 42 gradually decreases in diameter from thirty-six inches at one inch in height to twenty-four inches at eight inches in height.

The exemplary contoured circular hollow base 36 includes a third contour 44 from eight inches in height to nine inches in height. The diameter of the third contour 44 gradually decreases in diameter from twenty-four inches at eight inches in height to three inches at nine inches in height.

The exemplary contoured circular hollow base 36 includes a fourth contour 46 from nine inches in height to ten inches in height. The fourth contour 46 is one-quarter to three-quarters of inch in thickness and includes a central vertical hollow component 48 with an outside diameter of 3 inches and an inside diameter of 2.28 inches. This diameter is used to accommodate a circular pole 18 of 2.25 inches.

The contoured circular hollow base 36 also includes an attached rubberized non-skid, non-marring bottom plate 14. The bottom plate 14 is shown detached in FIG. 3A for illustrative purposes, but is normally attached to the contoured hollow base 36.

In one embodiment of the invention, the bottom plate 14 comprises a rubberized gasket with a raised lip comprising a diameter of 36.75 inches to be used with a first contour 38 of thirty-six inches in diameter and a height of 0.75 inches. In such an embodiment, the bottom plate 14 is attached over the contoured circular hollow base 36.

In another embodiment of the invention, the bottom plate 14 comprises a rubberized non-skid, non-marring with diameter of 35.875 inches and a height of 0.758 inches to be used with the contoured circular hollow base 36 with a first contour 38 of thirty-six inches in diameter and a first horizontal hollow component 40 of one-inch in height. In such an embodiment, the bottom plate 14 is attached inside the horizontal hollow component 40 of contoured circular hollow base 36

In such an embodiment, since the bottom plate 14 has a diameter slightly smaller than the first contour 38 of contoured circular hollow base 36, the bottom plate 14 is also used to create and maintain a seal between the contoured circular hollow base 36 and a surface, such as an exercise floor it is being used upon as was explained above.

In one embodiment of the present invention, the contoured circular hollow base 36 comprises a single piece of brushed clear-coated stainless steel of varying colors (e.g., red, green, blue, natural steel, etc.). However, the invention is not limited to such an embodiment and the contoured circular hollow base 36 can comprise other materials (e.g., composite materials, other metals, plastics, etc.) other coatings and other colors.

The contoured central hollow circular base 36 also comprises a weight of approximately fifty pounds and also includes hollow, fillable walls that can be filled with sand or other materials to comprise a weight of approximately 200 pounds when filled for additional stability.

The diameter and heights of the central hollow circular base 12 and the contoured circular hollow bases 36 both are specifically selected to fit through small standard-size doorway openings (e.g., thirty-two inch to thirty-six inch doorways).

Figure 3B:
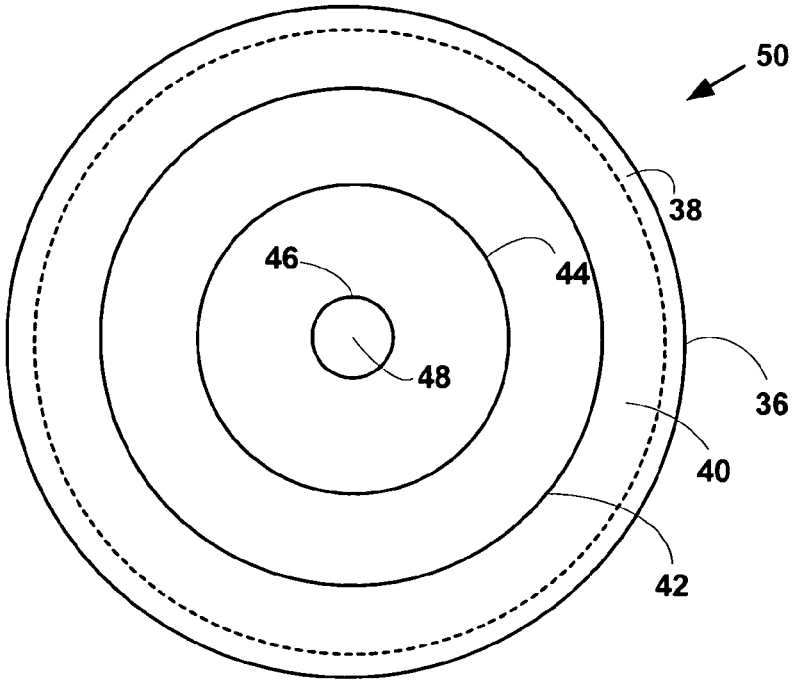
FIG. 3B is a block diagram illustrating a top view of the exemplary contoured circular hollow base of FIG. 3A.

FIG. 3B is a block diagram illustrating a top view 50 of the exemplary contoured circular hollow base 36 of FIG. 3A.

Figure 3C:
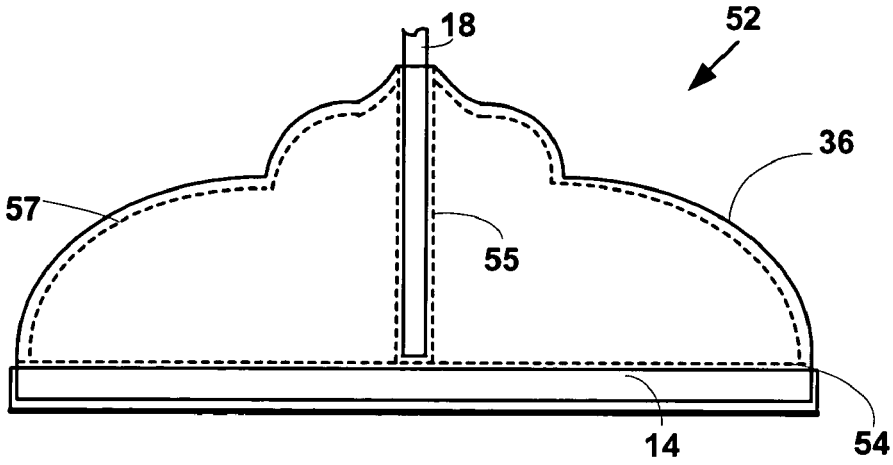
FIG. 3C is a block diagram illustrating another side view of the exemplary contoured circular hollow base of FIG. 3A.

FIG. 3C is a block diagram illustrating another side view 52 of the exemplary contoured circular hollow base 36 of FIG. 3A. This side-view illustrates a central hollow vertical component 55 including the vertical pole 18, a horizontal hollow component 54 including all or part of the bottom plate 14, and hollow, fillable walls 57 ranging from one-inch to three-inches in thickness. FIG. 3C illustrates a bottom plate 14 attached over the contoured circular hollow base 36.

Returning to FIG. 1, the vertical pole 18 includes plural exercise attachments 20, 20' (two of which are illustrated) attached to the vertical pole 18 with one or more mounting brackets 22. The plural exercise attachments 20 radiate out from the vertical pole 18.

Figure 4A:
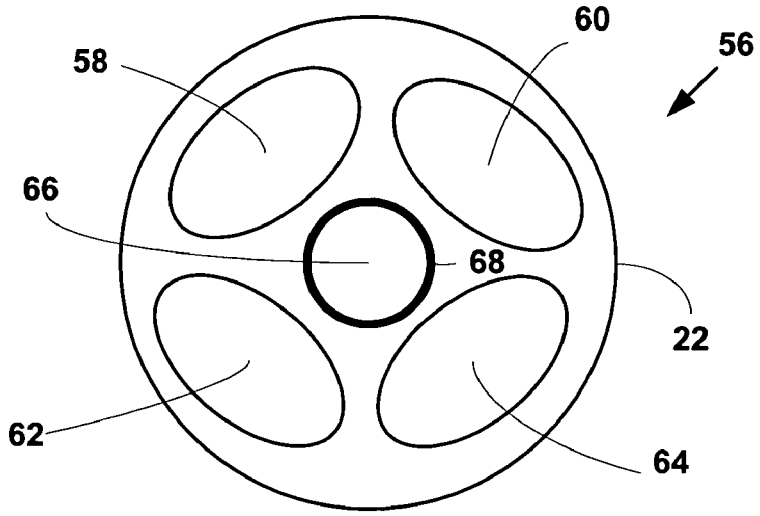
FIG. 4A is a block diagram illustrating a top view of a mounting bracket.

FIG. 4A is a block diagram illustrating a top view 56 of an exemplary mounting bracket 22. The mounting bracket 22 comprises a piece of stainless steel and includes a plural attachment points 58, 60, 62, 64 (four of which are illustrated for simplicity) for attaching the plural exercise attachments 20, an attachment point 66 and a mounting bracket collar 68 to mount the mounting bracket 22 on the vertical pole 18.

However, the present invention is not limited to a mounting bracket 22 with four attachment points and more or fewer attachment points can also be used. In addition, it is not limited to a mounting bracket 22 made of stainless steel and other metals and other materials such as plastic, composite materials, etc. can also be used for mounting bracket 22.

The mounting brackets 22 typically include twenty-four or more attachment points to attach twenty-four or more exercise attachments 20 equally (or unequally) spaced around the vertical pole 18 to accommodate twenty-four or more group exercise participants. In addition, a single mounting point, such as mounting point 58, is large enough and is typically used to attach plural exercise participants (e.g., 10 or more).

In another embodiment of the present invention, mounting bracket 22 includes plural attachment points comprising plural small round holes drilled with a diameter just slightly larger than an attachment clip used to attach an exercise attachment 20. In such an embodiment, only one exercise attachment 20 can be attached per hole. In such an embodiment, the mounting points cannot be used to attached plural exercise participants.

In another embodiment of the present invention, the mounting bracket 22 can also be mounted on a wall or other fixed surface.

Figure 4B:
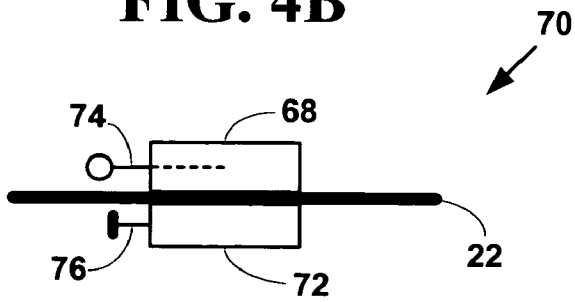
FIG. 4B is a block diagram illustrating a side-view of a mounting bracket.

FIG. 4B is a block diagram illustrating a side-view 70 of a mounting bracket 22. The mounting bracket 22 is in anchored in place on the vertical pole 18 by one or more attached mounting bracket collars 68, 72 (two of which are illustrated) attached above and/or below the mounting bracket 22. The mounting collars 68, 72 are illustrated as being detachable mounting bracket 22. However, the mounting bracket 22 can also include permanently attached mounting collars. The mounting bracket 22 can also include only a top mounting collar 68, or only a bottom mounting collar 72, or both a top mounting collar 68 and a bottom mounting collar 72.

In one embodiment of the present invention, the mounting collars 68, 72 may include spring loaded or non-spring loaded pins 74 that can be pushed into pre-drilled holes in the vertical pole 18 as is illustrated only on mounting collar 68. In another embodiment of the present invention, the mounting collars 68, 72 include an allen bolts, or other types of bolts or screws or pins (not illustrated).

In another embodiment of the present invention, the mounting collars 68, 72 include a screw with a handle 76 that can be tightened to engage the vertical pole 18 (e.g., with no pre-drilled holes) as is illustrated only on mounting collar 72. In yet another embodiment of the present invention, the mounting collars 68, 72 include a screw with a handle that is used to tightened the mounting collars 68, 72 themselves (not illustrated) to engage and hold the collars on the vertical pole 18 (e.g., with no pre-drilled holes).

In yet another embodiment of the present invention, the one or more mounting brackets 22 do not include mounting collars but instead include a resistance inside (e.g., rubber, nylon, etc.) surface (e.g., a coating, gasket, washer, etc.) to provide resistance when in contact with the vertical pole 18 to keep it at a desired location.

The one or more mounting brackets 22 allow the plural exercise attachments 20 to be moved in repetitive 360-degree movement patterns. The one or more mounting brackets 22 can be closely spaced to each other around the vertical pole 18 to create a centralized mounting point. The one or more mounting brackets 22 may also be attached widely spaced to form a singular mounting point and allowing a plurality of the one or more mounting brackets 22 to be moveable up and down, along and around the vertical pole 18.

Figure 5:
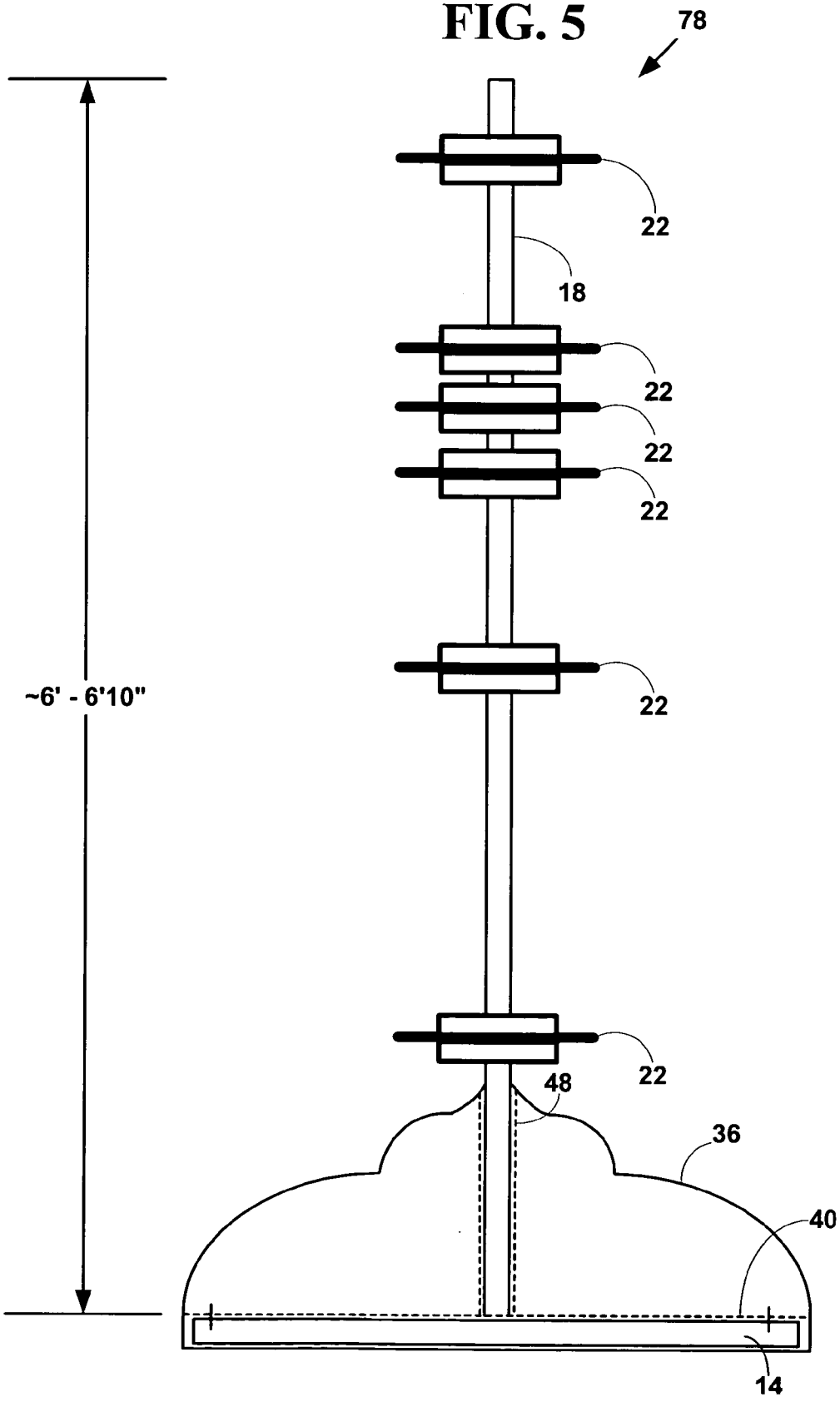
FIG. 5 is a block diagram illustrating a side-view of a vertical pole with plural mounting brackets including top and bottom mounting collars attached at plural different locations on the vertical pole.

FIG. 5 is a block diagram illustrating a side-view 78 of the vertical pole 18 with plural mounting brackets 22 including top 68 and bottom 72 mounting collars attached at a plural different locations on the vertical pole 18. FIG. 5 is illustrated with a bottom plate 14 that is attached inside the horizontal hollow component 40. However, the present invention is not limited to this embodiment and the bottom plate 14 can also comprise a rubberized gasket attached over the countered base 36 as is illustrated in FIG. 3C.

Returning to FIG. 1, in one embodiment of the present invention, the plural exercise attachments 20, 20' comprise elastic or rubber or otherwise flexible bands or tubes of varying thicknesses that are color coded and provide varying levels of resistance. For example, the plural exercise attachments 20 may include latex bands, non-latex bands, or rubber tubing or other types of flexible exercise attachments. For example, the plural exercise attachments 20 may include THERABAND brand products by Lifestyle Sports, Inc. or Dunkirk, N.Y., or SPRI brand products by SPRI Products, Inc. of Libertyville, Ill., or others. However, the present invention is not limited to THERABAND brand or SPRI brand products and bands or tubes by other manufacturers can also be used. In addition, the present invention is not limited to elastic or rubber bands or tubes and flexible tubes of other materials can also be used.

In other embodiments of the present invention, the plural exercise attachments 20 can also comprise cloth, metal, plastic, composite or other materials. The plural exercise attachments 20 can include plural solid poles, flexible cords or straps, non-flexible cords or straps, or other types of exercise attachments 20 such as cables or flexible rods or arms. The plural exercise attachments 20 may also be attached to cables or pulley systems that are in turn attached to stacks of weights, or flexible rods or arms attached to vertical pole 18 and/or central hollow circular bases 12, 36 (not illustrated).

Table 1 illustrates an exemplary color-coded resistance scheme for the plural exercise attachments 20 when elastic or rubber bands or tubes are used. However, the present invention is not limited to the colors or resistance levels illustrated in Table 1 and more, less, or different colors and resistance levels and other thicknesses can also be used.

TABLE 1

| Color | Resistance Level | Thickness |
|---|---|---|
| Tan | Extra Light | 0.25" |
| Yellow | Light | 0.50" |
| Red | Medium | 0.75" |
| Green | Heavy | 1.00" |
| Blue | Extra Heavy | 1.25" |
| Black | Very Heavy | 1.75" |

An exercise participant desiring to exercise would select a desired level of resistance by selecting an appropriate color and thickness for the exercise attachment 20 from a rack including the plural exercise attachments 20, 20'. For example, a first exercise participant desiring a light workout might select a set of yellow exercise attachments 20. A second exercise participant desiring a very heavy workout might select a set of black exercise attachments 20'. Both sets of exercise attachments 20, 20' can be attached to the same or a different mounting bracket 22 attached to the vertical pole 18 allowing simultaneous group or individual physical activity.

In one embodiment of the present invention, a whole group of exercise participants may select exercise attachments 20 with the same color and thickness to participate in a uniform group physical activity (e.g., all yellow exercise attachments) where each exercise participant is considered to be a the same or similar fitness level.

In another embodiment of the present invention, each exercise participant may select their own exercise attachments 20 with a select color and thickness to participate in a group physical activity, but where each individual exercise participant is at a different fitness level.

Figure 6:
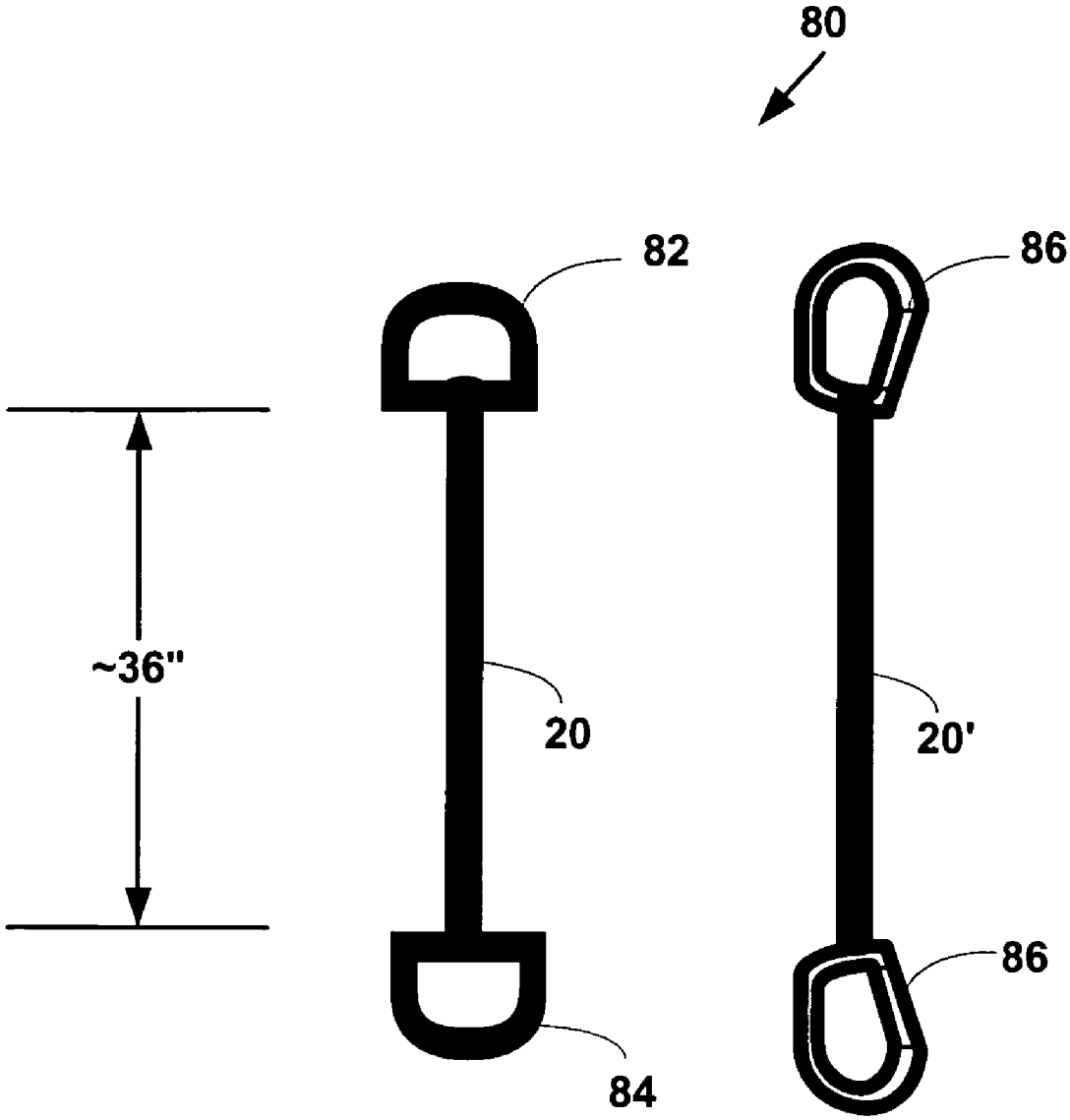
FIG. 6 is a block diagram illustrating details of the plural exercise attachments.

FIG. 6 is a block diagram illustrating details 80 of the plural exercise attachments 20. The plural exercise attachments 20 include plural mounting clips 82 and 84 attached at opposite ends of the exercise attachments 20.

In one embodiment of the present invention, the plural mounting clips 82 and 84 are both plastic "D" shaped rings. In such an embodiment, one or more of the mounting clips 82, 84 may be attached to a carabiner clip. In another embodiment of the present invention, a first of the mounting clips 82 is a "D" shaped ring and a second of the mounting clips 84 is a carabiner clip 86 (not illustrated).

In yet another embodiment of the present invention, both of the mounting clips 82 and 84 are both carabiner clips 86. The carabiner clips 86 allow quick, easy and efficient attachment/detachment of the exercise attachments 20.

However, the present invention is not limited to such mounting clips and other types and shapes of mounting clips and mounting rings including mounting clips and mounting rings comprising other materials (e.g., metals, composite materials, etc.) can also be used.

In one embodiment of the present invention, all the plural exercise attachments 20 are thirty-six inches in length. However, the present invention is not limited to such an embodiment and the plural exercise attachments 20 can be shorter or longer lengths. In addition, the plural exercise attachments 20 can include plural different lengths.

Figure 7:
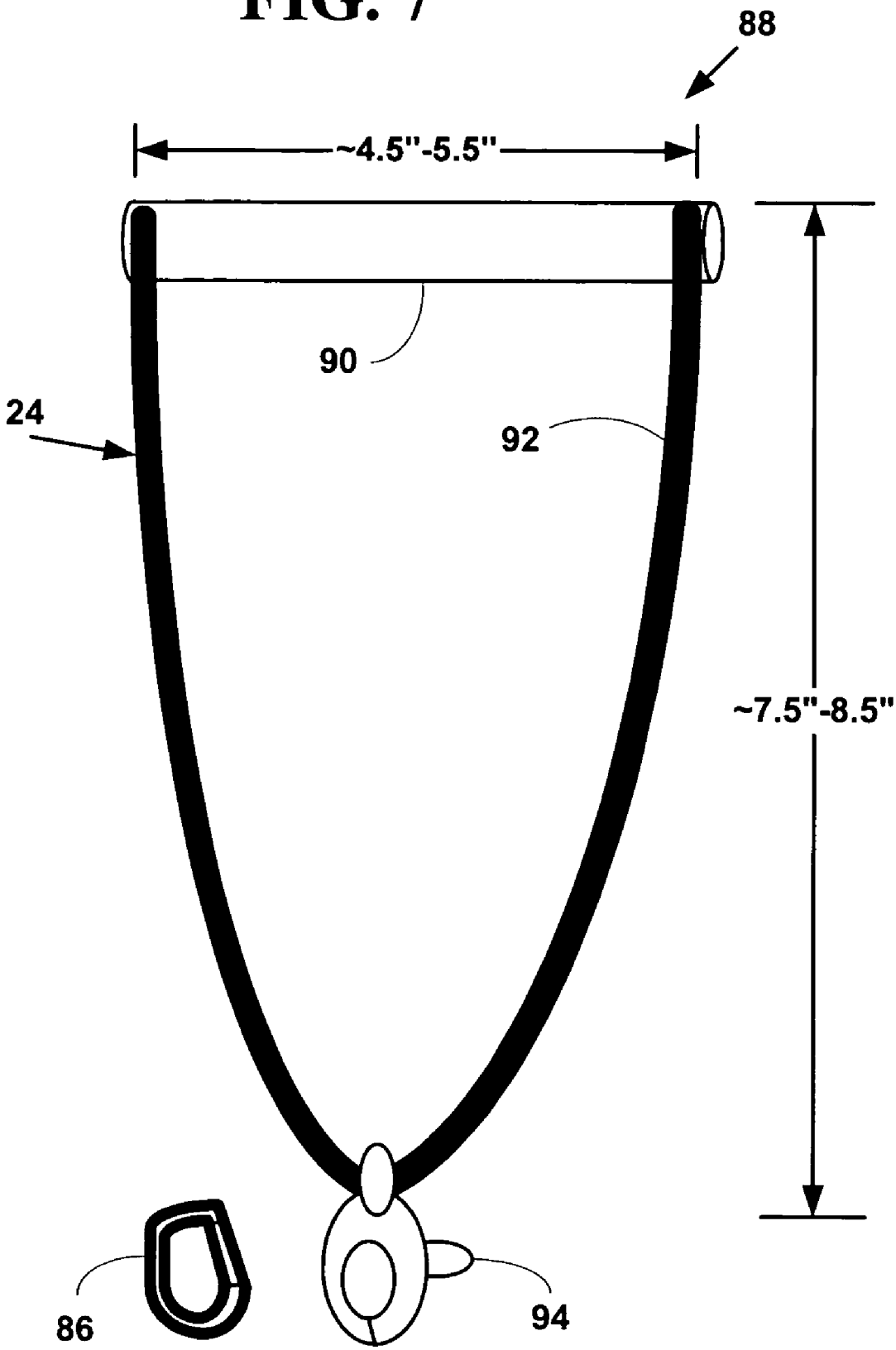
FIG. 7 is a block diagram illustrating details of one of the plural handle attachments.

FIG. 7 is a block diagram illustrating details 88 of one embodiment of the plural handle attachments 24. The handle 24 includes a grip component 90. In one embodiment of the present invention, the grip component 90 is a circular rod comprising a hard plastic, metal or composite material approximately 4.5 inches to 5.5 inches in length with a diameter of 0.75 inches covered by a layer of foam, which is in turn, covered by a layer of non-slip plastic, rubber or leather. However, the present invention is not limited to such a grip component 90 and other measurements and other materials can also be used.

The handle 24 further includes a strap component 92. In one embodiment of the present invention, the strap component 92 is at least 7.5 inches long to allow an exercise participant to complete a physical activity while changing hand, wrist or arm positions without having the strap component 92 interfere with the exercise participant's forearm or elbow, or other body parts while exercising.

The 7.5 inch length of the strap component 92 extends the handle 24 and makes it larger than most handles for exercise equipment know in the art. The 7.5 inch length was selected to provide a comfortable handle 24 for a wide variety of male and female exercise participants of a wide variety of sizes and shapes.

In another embodiment of the present invention, the strap component 92 is less than 7.5 inches long. In another embodiment of the present invention, the strap component 92 is 7.5 inches to twelve inches long.

However, the present invention is not limited to these specific measurements and other measurements can also be used to allow an exercise participant to complete a physical activity while changing hand, wrist or arm positions without having the strap component 92 interfere with the exercise participant's forearm or elbow, or other body parts while exercising.

In one embodiment of the present invention, the strap component 92 comprises a nylon webbing material one inch in width. However, the present invention is not limited to such an embodiment and other materials and other widths can also be used for the strap component 92

The handle 24 further includes a release clip 94. The release clip 94 is used to attach the handle 24 to an exercise attachment 20. In one embodiment of the present invention, the release clip 94 is a metal release clip with a spring-resistance or other resistance component that can be compressed or moved to release the clip. In another embodiment the release clip 94 is a carabiner clip. However, the present invention is not limited to the release clip 94 illustrated, other types of releasable clips (e.g., carabiner clips) and non-releasable clips of other materials can also be used (e.g., plastic, composite materials, etc.).

In another embodiment of the present invention, the handle 24 does not include a release clip 94. In such an embodiment, the plural exercise attachments 20 instead include a release clip such as a carabiner clip 86 (FIG. 6).

In another embodiment of the present invention, the handle 24 may include an inverted "T-shaped" handle (not illustrated) to allow an exercise participant to grasp the handle 24 with both hands. However, other handle shapes may also be used and the present invention is not limited to the handle 24 and the handle components described.

In another embodiment of the present invention, the grip component 90 may be extended to 10.5 inches or more in length extend beyond both of its connections to the strap component 92 (not illustrated). Such an embodiment can also be used for two hand gripping by an exercise participant.

Figure 8:
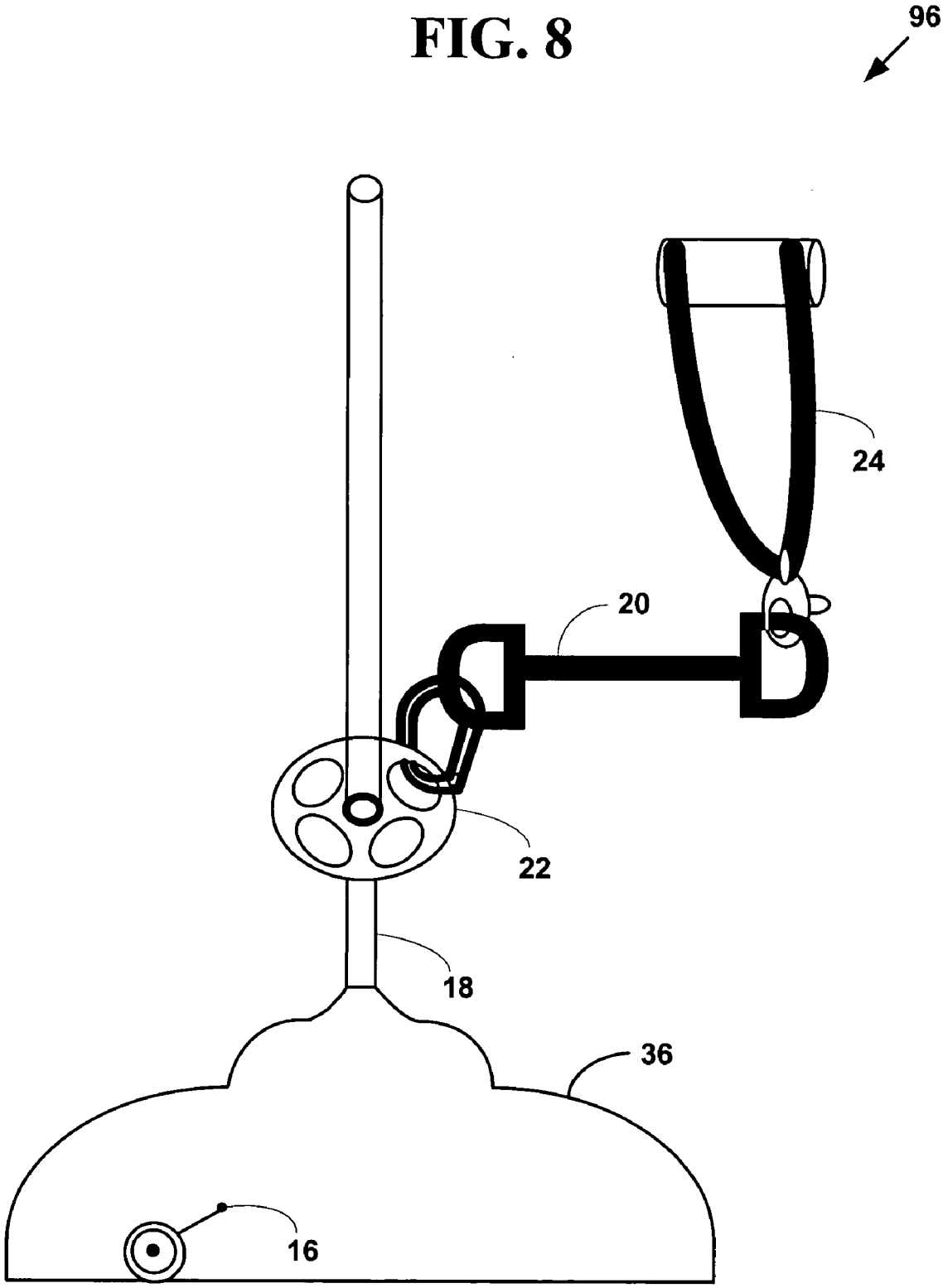
FIG. 8 is a block diagram illustrating details of an exemplary connections of selected components of the circular fitness apparatus.

FIG. 8 is a block diagram illustrating details 96 of exemplary connections of selected components of the circular fitness apparatus 10. However, the present invention is not limited to such connections, and other types of connections and other combinations of connections can also be used. This block diagram is not drawn to scale.

Returning to FIG. 1, the central hollow circular base 12 and central hollow contoured circular base 36 includes plural wheels 16 for transport. In one embodiment of the present invention, the plural wheels 16 include two or more "twist-wheels" that are twisted to engage, and untwisted to disengage. For example, the twist-wheels are twisted to engage them and move the circular fitness apparatus 10 to a new location. Then the wheels are dis-engaged.

In another embodiment of the present invention, the plural wheels 16 include two or more "tilt-n-steer" wheels that allow the circular fitness apparatus 10 to be tilted and pushed or pulled around from place-to-place. (See FIG. 8). The tilt-n-steer are engaged when the central hollow circular base 12 and central hollow contoured circular base 36 are tilted and disengaged when they are not.

In one embodiment of the present invention, the wheels 16 are evenly spaced around central hollow circular base 12 and contoured base 36. In another embodiment of the invention, the wheels 16 are un-evenly spaced. However, the present invention is not limited to such wheels and wheel spacing and other types of wheels 16 and spacing can also be used.

The circular fitness apparatus 10 is typically used as a free standing apparatus used for 360 degree individual or group exercise activities around the central hollow circular base 12 or countered base 36. In another embodiment of the present invention, the circular fitness apparatus 10 can be permanently mounted to a wall and used for individual or group exercise activities for less than 360 degree individual or group exercise activities.

The circular fitness apparatus 10 is used in health and fitness clubs for group exercise or individual exercise activity. The circular fitness apparatus 10 is useable for individual or group exercise activities comprising health based, skill based and functional based fitness activities.

Circular Fitness Apparatus Exercise Methods

Figure 9:
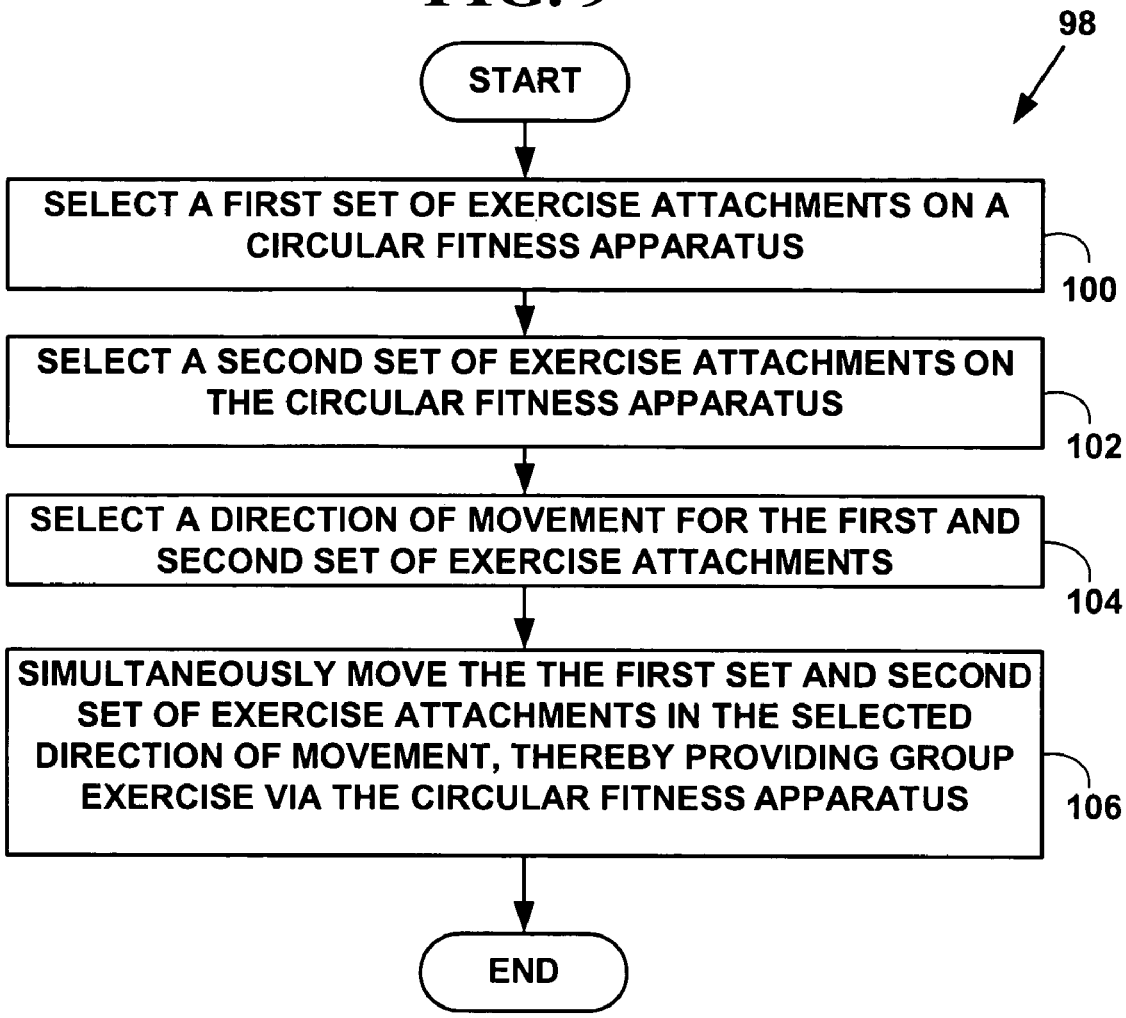
FIG. 9 is a flow diagram illustrating a circular fitness method.

FIG. 9 is a flow diagram illustrating a circular fitness Method 98. At Step 100, a first set of exercise attachments 20 are selected on the circular fitness apparatus 10. At Step 102, a second set of exercise attachments 20' are selected on the circular fitness apparatus 10, other than the first set exercise attachments 20. At Step 104, a direction of movement is selected for the first set of exercise attachments 20 and for the second set of exercise attachments 20'. The direction of movement is the same for the both the first and second set of exercise attachments. At 106, the first set and the second set of exercise attachments 20' are simultaneously moved in the selected direction of movement respectively, thereby providing group exercise via the circular fitness apparatus 10.

In another embodiment of the present invention, the first or second set of exercise attachments 20, 20' can be moved in a direction opposite or at some other angle to the selected direction of movement selected at Step 104, thereby also providing different types group exercise activities.

Figure 10:
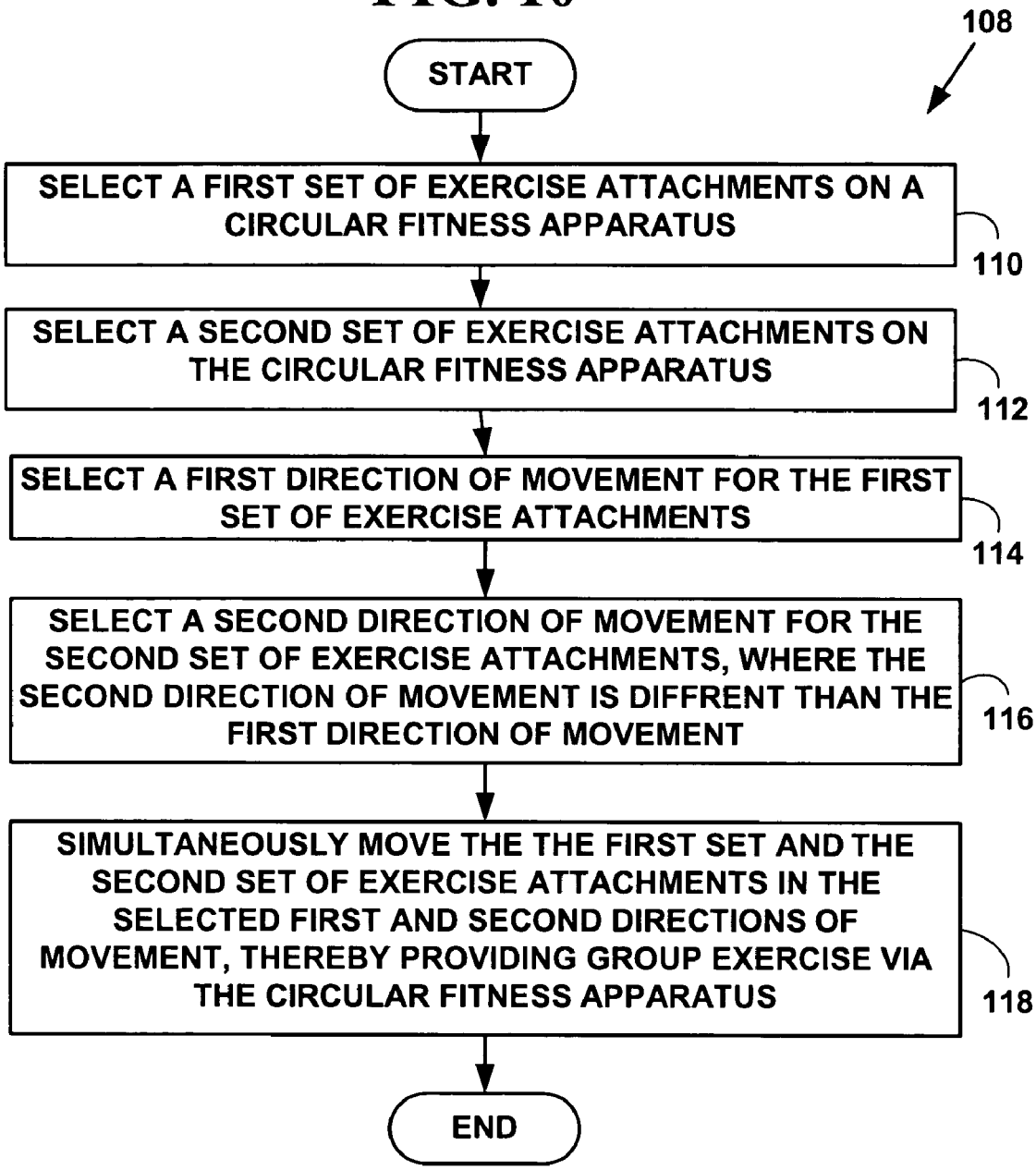
FIG. 10 is a flow diagram illustrating a circular fitness method.

FIG. 10 is a flow diagram illustrating a circular fitness Method 108. At Step 110, a first set of exercise attachments 20 are selected on the circular fitness apparatus 10. At Step 112, a second set exercise of attachments 20' are selected on the circular fitness apparatus 10, other than the first set of exercise attachments 20. At Step 114, a first direction of movement is selected for the first set of exercise attachments 20. At Step 116, a second direction of movement is selected for the second set of exercise attachments 20'. The second direction of movement is different than the selected first direction of movement. At 118, the first set of exercise attachments 20 and the set of second exercise attachments 20' are simultaneously moved in the first and second selected directions of movement respectively, thereby providing group exercise via the circular fitness apparatus 10.

In embodiments of the present invention, a exercise participant typically selects a set of two exercise attachments 20 (FIG. 6), including two handles 24 (FIG. 7) for example, to be used for both of the exercise participant's arms or legs. However, an exercise participant may also select a set of one exercise attachment 20 (e.g., or one arm, one leg, the neck, etc.), with an inverted "T-shaped" handle or an extended handle as described above for two-hand gripping. Or an exercise participant may select a set of more than two exercise attachments 20, (e.g., four exercise attachments 20, with four handles 24 for both arms and both legs, etc.).

The circular fitness apparatus 10 can also be used from standing, sitting, squatting position and other positions. The circular fitness apparatus 10 allows a wide variety of exercise movements including those targeted to the major and minor muscle groups of the human body. The methods described herein are useable for individual or group exercise activities comprising health based, skill based and functional based fitness activities.

Moving around the circular fitness apparatus 10 enables an exercise participant to train in a multi-planar environment, which may enable the exercise participant's body to become stronger and more efficient in every day activities. Core integrated movement patterns require balance and stability, due to the constant changing of positions on the circular fitness apparatus 10 which occur during the duration of a training session. Such balance and stability combined with large movement patterns as opposing forces result in a challenging and unique way of group exercise training. Opposing forces of each exercise participant are equalized on the circular fitness apparatus 10, thus creating an additional type of training element and camaraderie within the group.

Illustrative use of the Circular Fitness Apparatus

The circular fitness apparatus of FIG. 1 may be used by plural exercise participants (e.g. by using Method 98 of FIG. 9 or Method 108 of FIG. 10) in a standing position, sitting position or other positions and with other movements as was described above.

It should be understood that the methods and apparatus described herein are not related or limited to any particular type of materials unless indicated otherwise. Various combinations of general purpose, specialized or equivalent materials and components may be used with or to perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more fewer or equivalent elements may be used for the components described in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

I claim:

1. A circular fitness apparatus, comprising:

a central hollow circular base;

a bottom plate attached to the central hollow circular base, wherein the bottom plate is used to help seal the central hollow circular base to a surface;

a vertical pole attached in a central vertical hollow component of the central hollow circular base;

one or more moveable mounting brackets attached to the vertical pole, each bracket including a plurality of attachment points for attaching a plurality of exercise attachments, wherein the attached plurality of exercise attachments allows simultaneous group or individual exercises to be completed at various locations around the vertical pole and wherein each of the plurality of attachment points can be used to attach a plurality of exercise attachments;

a plurality of resilient exercise attachments attachable at one end to the one or more moveable mounting brackets with a first removable clip and attachable at another end to a handle attachment via a second removable clip, wherein the plurality of exercise attachments provide a plurality of different levels of resilient resistance for exercise activities; and a plurality of handle attachments attachable to the plurality of exercise attachments via the plurality of second removable clips, wherein the plurality of handle attachments include a pre-determined size large enough to allow an exercise participant to complete a physical activity via the vertical pole while changing positions without interfering with any of an exercise participant's body parts.

2. The circular fitness apparatus of claim 1 further comprising a plurality of wheels attached to the central hollow circular base for moving the central hollow circular base to a new location.

3. The circular fitness apparatus of claim 1 wherein the central hollow circular base comprises a diameter of twenty-four inches to a diameter of thirty-six inches.

4. The circular fitness apparatus of claim 1 wherein the central hollow circular base comprises a plurality of contours of decreasing size.

5. The circular fitness apparatus of claim 1 wherein the central hollow circular base comprises stainless steel with hollow, fillable walls, a horizontal hollow component for attaching the bottom plate and the central vertical hollow component for attaching the vertical pole.

6. The circular fitness apparatus of claim 1 wherein the central hollow circular base comprises a single piece stainless steel with hollow, fillable walls and a plurality of contours.

7. The circular fitness apparatus of claim 1 wherein the bottom plate comprises a diameter of thirty-five and three quarter inches for a central hollow circular base comprising a diameter of thirty-six inches and comprises a height of three-quarter inches, wherein the bottom plate is attached inside a horizontal hollow component in the central hollow circular base with a height of one inch.

8. The circular fitness apparatus of claim 1 wherein the bottom plate comprises a rubberized gasket with a raised lip with a diameter of a diameter of thirty-six and three quarter inches, wherein the bottom plate is attached over a central hollow circular base comprising a diameter of thirty-six inches.

9. The circular fitness apparatus of claim 1 wherein the vertical pole includes a stainless steel pole that ranges in height from six feet to six feet ten inches and comprises a diameter of 2.25 inches.

10. The circular fitness apparatus of claim 9 wherein the one or more moveable mounting brackets include up to twenty-four attachment points each for attaching a plurality of exercise attachments.

11. The circular fitness apparatus of claim 1 wherein the plurality of exercise attachments comprise a plurality of rubber or elastic tubes or bands.

12. The circular fitness apparatus of claim 1 wherein the plurality of exercise attachments comprise flexible bands or tubes including a plurality of different thicknesses providing varying levels of resistance for exercise activities.

13. The circular fitness apparatus of claim 1 wherein the plurality of exercise attachments comprise a plurality of colors indicating varying levels of resistance for exercise activities.

14. The circular fitness apparatus of claim 1 wherein the first and second removable clips include a release clip or a carabiner clip.

15. The circular fitness apparatus of claim 1 wherein the first and second removable clips are the same type of removable clip.

16. The circular fitness apparatus of claim 1 wherein the first and second removable clips are different types of removable clips.

17. The circular fitness apparatus of claim 1 wherein the plurality of handle components include a grip attachment and a strap attachment.

18. The circular fitness apparatus of claim 17 wherein the strap attachment is at least 7.5 inches long.

* * * * *